US007168110B2

(12) United States Patent
Girard et al.

(10) Patent No.: US 7,168,110 B2
(45) Date of Patent: Jan. 30, 2007

(54) PARAMEDICAL TRANSFER STRETCHER, HARNESS AND METHOD

(76) Inventors: Benoit Girard, 620 Pascal, Repentigny, Québec (CA) J6A 7G3; Sylvie Charette, 620 Pascal, Repentigny, Québec (CA) J6A 7G3

( * ) Notice: Subject to any disclaimer, the term of this patent is extended or adjusted under 35 U.S.C. 154(b) by 0 days.

(21) Appl. No.: 11/012,825

(22) Filed: Dec. 16, 2004

(65) Prior Publication Data

US 2005/0132495 A1 Jun. 23, 2005

(30) Foreign Application Priority Data

Dec. 16, 2003 (CA) ..... 2454139

(51) Int. Cl.
*A61G 1/013* (2006.01)
*A61G 1/044* (2006.01)
*A61G 7/10* (2006.01)

(52) U.S. Cl. ..... 5/89.1; 5/81.1 T; 5/627; 5/628; 5/83.1

(58) Field of Classification Search ..... 5/81.1 R, 5/81.1 T, 83.1, 85.1, 89.1, 625–628; 294/140
See application file for complete search history.

(56) References Cited

U.S. PATENT DOCUMENTS 1,711,167 A * 4/1929 Blake ..... 182/230
2,232,406 A 2/1941 Schmelzer
2,262,067 A 11/1941 Togesen et al.
2,418,608 A 4/1947 Thompson et al.
3,066,320 A * 12/1962 Russell ..... 5/628
4,679,260 A * 7/1987 Frettem ..... 5/627
5,839,137 A * 11/1998 Butler et al. ..... 5/627
5,978,989 A * 11/1999 Chavez ..... 5/627
6,276,006 B1 * 8/2001 Hoit ..... 5/81.1 R
6,363,936 B1 * 4/2002 McCormick et al. ..... 128/870

FOREIGN PATENT DOCUMENTS

WO WO 91/03221 * 3/1991

* cited by examiner

*Primary Examiner*—Michael Trettel
(74) *Attorney, Agent, or Firm*—Protections Equinox Int'l Inc.; Franz Bonsang, Patent agent

(57) ABSTRACT

This invention describes a transfer stretcher, harness and method designed to lift, transfer or support a person, more specifically a heavy weight, large size (oversize) person. Stretchers are generally used by hospitals or by rescue/emergency units to lift or carry a person from one location to another. The transfer stretcher covered by the present invention is made of a supporting canvas equipped with lifting straps and rings, a removable washable comfort cloth, and maybe used with a removable safety harness that can be used with a stretcher basket and a sling frame. The transfer stretcher can be used to move a body manually with the help of several persons, or in combination with various lifting equipment.

27 Claims, 10 Drawing Sheets

PARAMEDICAL TRANSFER STRETCHER, HARNESS AND METHOD

FIELD OF THE INVENTION

The present invention covers a paramedical transfer stretcher, harness and method which are more particularly designed to transfer a person that cannot be directly lifted by hand because of his/her excess weight, size, physical handicap, health condition or limited accessibility.

INVENTION BACKGROUND

There are devices already available to lift a person with the help of lifting equipment that use a one piece sheet with straps, and that are sometimes provided with handles, and which are usually used in combination with a body lifting hoist. Those single piece stretchers are generally used in hospital facilities to lift a standard size person a few feet above ground, either to transfer the person from a bed to a bathtub or a chair. Those sheets have a limited lifting capacity and duty cycle. They are not designed to tolerate human body fluids resulting from paramedical operations, and they generally need to be washed and therefore get worn out by bleaching agents, hence loosing their mechanical strength. They have a relatively low safety factor, usually around 2.5 times their rated loading capacity. They are vulnerable to tear, are unsafe and uncomfortable for an oversize person. See for example those shown in Canadian Patent no. 2,262,067 and in Canadian Patent application no. 2,232,406.

Other apparatuses are also available such as shell stretchers, splints and baskets used for emergency care which are generally made of rigid components that aren't adaptable and require a manual lifting of the body so that it can be laid down on the rigid component. Once installed on the rigid component, the body can be moved or lifted several feet above ground manually or with the help of a mechanical lifting device such as a hoist. Those devices may be equipped with belts or straps to stabilise the body and prevent it from falling. Those devices aren't designed for large size heavy weight persons whom cannot be lifted manually and laid down on the transfer component. When the body is rolled over on this type of device, the frame of the device or its mechanism will usually get in the way and may hurt the person.

The main problem with body transfer devices currently available is that they aren't designed for large size heavy weight persons.

Attempts have been made to find solutions for these problems. For example, U.S. Pat. No. 5,978,989 describes a paramedical stretcher destined to transport corpulent persons. However, the person is not attached to the stretcher and only his or her feet may be placed in a foot pocket.

The use of those existing devices can be unsafe not only for the person who needs to be moved but also for the paramedics staff. Therefore, whereas the existing devices aren't fully suitable, there is a need on the market for a safer and better designed paramedical transfer device for large size heavy weight persons.

INVENTION SUMMARY

The present invention relates to a transfer stretcher, harness and method. The transfer stretcher, harness and method are designed to pull up, transfer or lift up a person, more specifically a large size overweight person. The transfer stretcher is composed of a support canvas equipped with lifting rings and straps capable of lifting a heavyweight person, a removable and washable comfort sheet to hygienically protect the patient and retain body fluids and is preferably used with a detachable safety harness to prevent falls. A stretcher basket, with optional wheels and removable bottom, and a sling frame that can also be used for horizontal body transfer.

The transfer stretcher, harness and method of the present invention can be used to manually move a person with the assistance of several helpers as required, using the handles affixed to the support canvas and designed for that purpose. Color coded straps and rings are also provided with the support canvas to lift up a person using a mechanical lifting device designed to lift a person in a seated or tilted position. Also used with the canvas is a harness which is made of several components, namely a dorsal part, a front part and a leg part, or could be made in two parts, i.e. a dorsal part including the leg part, and a front part, and which is used to lift up a person with the help of mechanical lifting devices. Along with the canvas, the dorsal and the leg parts of the harness are used in combination with a lifting device to lift up and move a person horizontally. Along with the canvas, the dorsal, leg and front parts of the harness can be used in combination with a crane, a basket, a fire truck ladder or any suitable lifting device to lift and move a person vertically or horizontally. The person can be lifted up and moved as required only with the use of the three parts of the harness. The paramedical transfer stretcher and harness are designed to be used as the bottom part of stretcher basket as it will allow to roll over or lift up a body horizontally with the assistance of several helpers or the use of a mechanical lifting device.

A transfer stretcher for single large size overweight person according to the invention will preferably include: a reinforced, padded support canvas, along with at least two color coded straps and rings that will be used to support and lift the person, at least four handles for hand lifting, a retaining system to secure the straps and prevent hurting the person when handling the canvas, openings to insert safety harness straps, and Velcro® type strips on the edge to hold the comfort sheet in place.

The transfer stretcher is preferably used with a safety harness preferably made of two or more parts, with one part provided with at least two adjustable thigh belts located between the crotch and thee knees, at least two shoulder belts to receive the front part of the harness, one waist belt to receive the front part of the harness, at least one optional belt to hold the legs, one belt with lifting ring to lift the person vertically, a plurality of belts with lifting rings to lift the person in seated or horizontal position, a series of rings to tie the support canvas to the stretcher basket, a front piece to stabilise the body and equipped with at least two padded belts to hold the shoulders and receiving the back part of the harness, a belt to hold the waist and receiving the back part of the harness, and a chest belt to maintain the distance between the shoulder belts.

Preferably, a washable, removable, hygienically protective comfort sheet made of medical fabrics, that can retain body fluids is also used. It is held in place by Velcro® type sticking strips on the edge. The comfort sheet comes with openings to insert the safety harness straps, complete with flaps on the edge with Velcro® type strips to hold the comfort sheet and protect the person from being injured by the support canvas.

The stretcher may optionally be placed in a stretcher basket with a removable bottom, and equipped with hydraulic jacks and wheels to roll the body on short distances. The body can be lifted up manually with the assistance of several persons by grabbing the frame, moving the body horizontally several feet above ground with the help of a mechanical lifting device, or rolling the body directly into an ambulance or in a hospital.

A sling frame with at least three slings out of which at least two are adjustable to lift one person, either in a horizontal or tilted position may also be used with the use of a basket or directly with a harness, the slings are held together by a frame to take up lateral loads.

The transfer device, generally made for a large size heavy weight person will preferably include the following parts:

a padded, reinforced support canvas equipped with six color coded straps with lifting rings to support and lift a person, along with nine handles for manual lifting, a retaining system to hold the straps and prevent body injuries when handling the canvas, with openings to insert the safety harness straps, and Velcro® type strips around the edge to hold the comfort sheet in place;

a three piece safety harness, with one part provided with two adjustable thigh belts located between the crotch and thee knees, two shoulder belts to receive the front part of the harness, two waist belts to receive the front part of the harness, two optional belts to hold the legs, two belts with lifting rings to lift the person vertically, eight belts with lifting rings to lift the person in seated position, ten belts with lifting and tying rings to lift a person horizontally and attach the support canvas to the stretcher basket, a front piece to stabilise the body and equipped with two padded belts to hold the shoulders and receiving the back part of the harness, at least one belt to hold the shoulders and receiving the back part of the harness, and a chest belt to maintain the distance between the shoulder belts; and a washable, removable, hygienically protective comfort sheet made of medical fabrics, that can retain body fluids, and is held in place by Velcro® type sticking strips on the edge. The comfort sheet comes with openings to insert the safety harness straps, complete with flaps on the edge with Velcro® type strips to hold the comfort sheet and protect the person from being injured by the support canvas.

When possible, the stretcher is preferably placed in a stretcher basket with a removable bottom, and equipped with four hydraulic jacks and four wheels to roll the body on short distances. The body can be lifted up manually with the assistance of several persons by grabbing the frame, move the body horizontally several feet above ground with the help of a mechanical lifting device, and roll the body directly into an ambulance or in a hospital.

A sling frame with four slings, out of which two are adjustable to lift one person, either in a horizontal or tilted position may also be used with a basket, the slings being held together by a frame to take up lateral loads.

DESCRIPTION OF A PREFERRED EMBODIMENT

Figure 1:
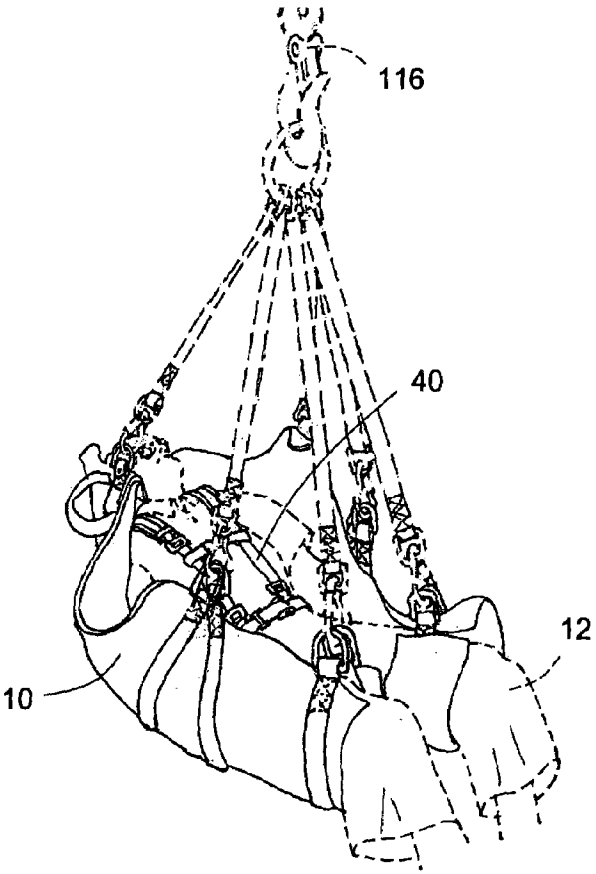
FIG. 1 is a perspective view of a paramedical transfer stretcher designed for a pathologically overweight person, which, according to the preferential purpose of the present invention, can be used, along with a harness equipped with belts and lifting rings, to lift a human body with the help of a crane, a boom basket, a fire truck ladder, or any other appropriate lifting device.

The present invention refers to a paramedical transfer stretcher 10 for a person 12 pathologically overweight, for paramedical application, as shown in FIG. 1 as well as to a harness and a method of using same.

Figures 2, 2A:
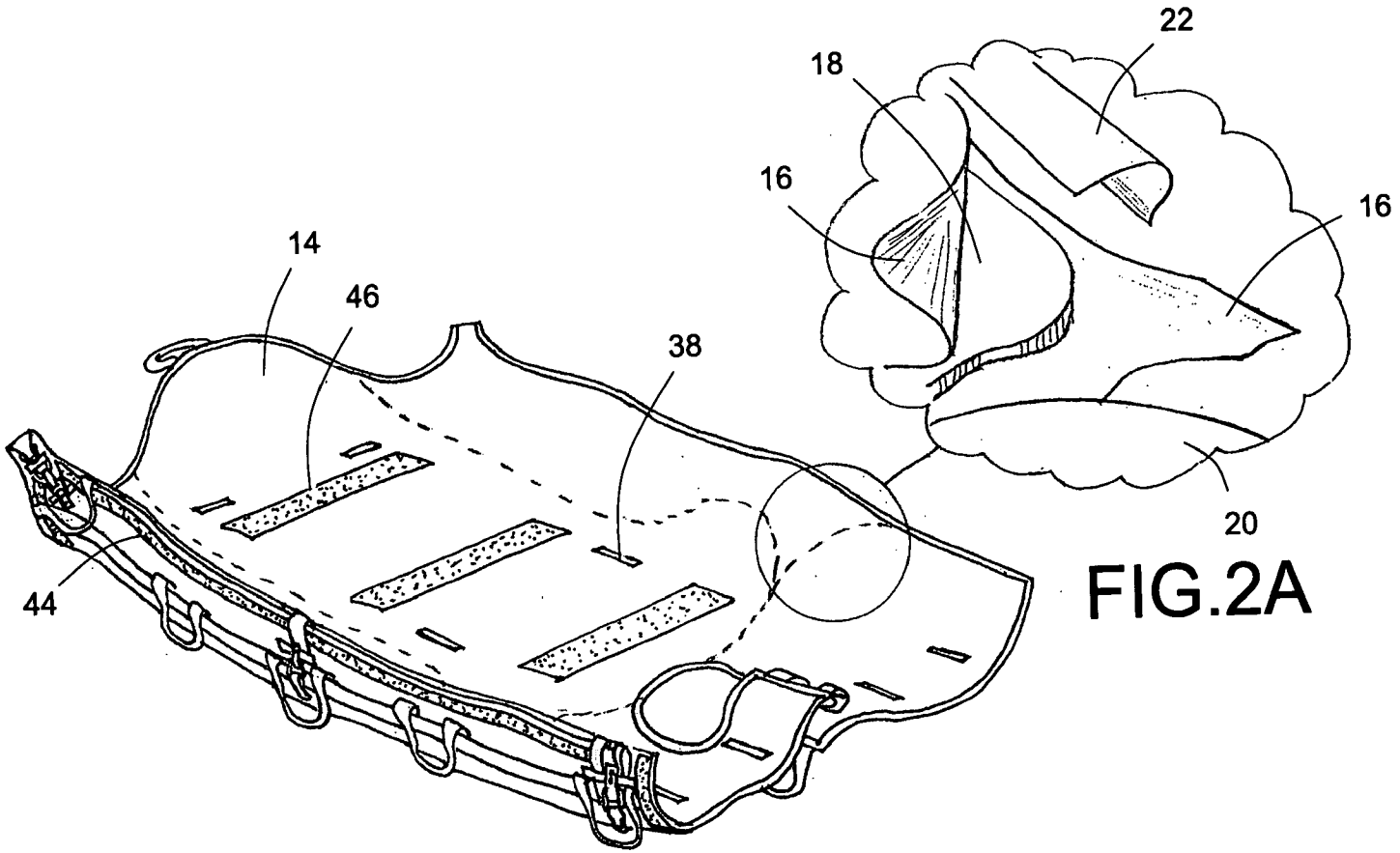
FIG. 2 is a perspective view of a support canvas used in a paramedical transfer stretcher designed for pathologically overweight person according to the preferential purpose of the present invention.
FIG. 2A is a detail view of a portion of the canvas shown in FIG. 2.

As shown in FIGS. 1 and 2, the paramedical transfer stretcher 10 includes a support canvas 14, more specifically composed of two sheets 16 made of resistant fabrics such as polyester fibre reinforced PVC. The support canvas 14 is preferably padded with a first layer of padding 18 and a second layer of padding 20 which can be made of encapsulated cell foam or any other appropriate padding material.

Figure 7:
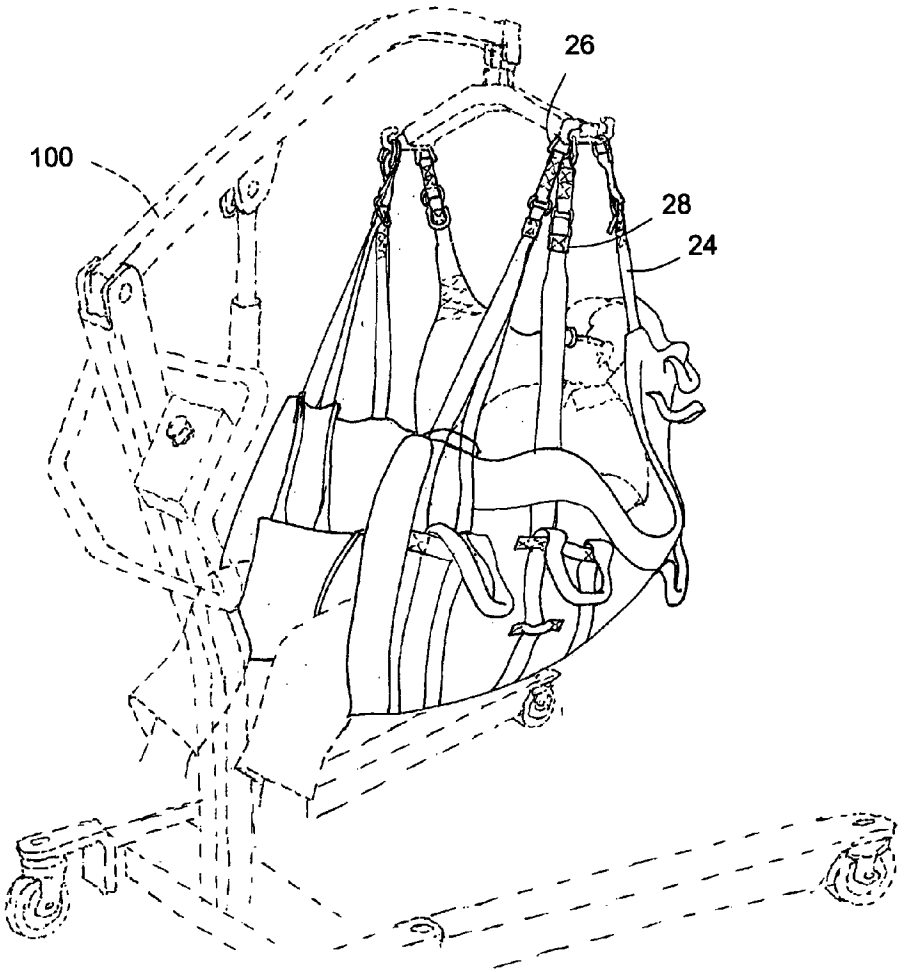
FIG. 7 is a perspective view of a paramedical transfer stretcher for pathologically overweight person, and is designed to lift a person with the help of a lifting device using color coded belts and rings according to the preferential purpose of the present invention.

The support canvas has a strip a nylon fabrics sewed on the edge 22 and is equipped with belts 24 that can also be made of nylon fabrics (as shown in FIG. 7). Each belt 24 will preferably have a lifting ring 26 at one end and can also be color coded 28 (shown in FIG. 7). The belts can be used to adjust the tilting angle of the transfer stretcher 10 and to lift a person 12 with the help of lifting device such as a body lifting hoist 100.

Figure 5:
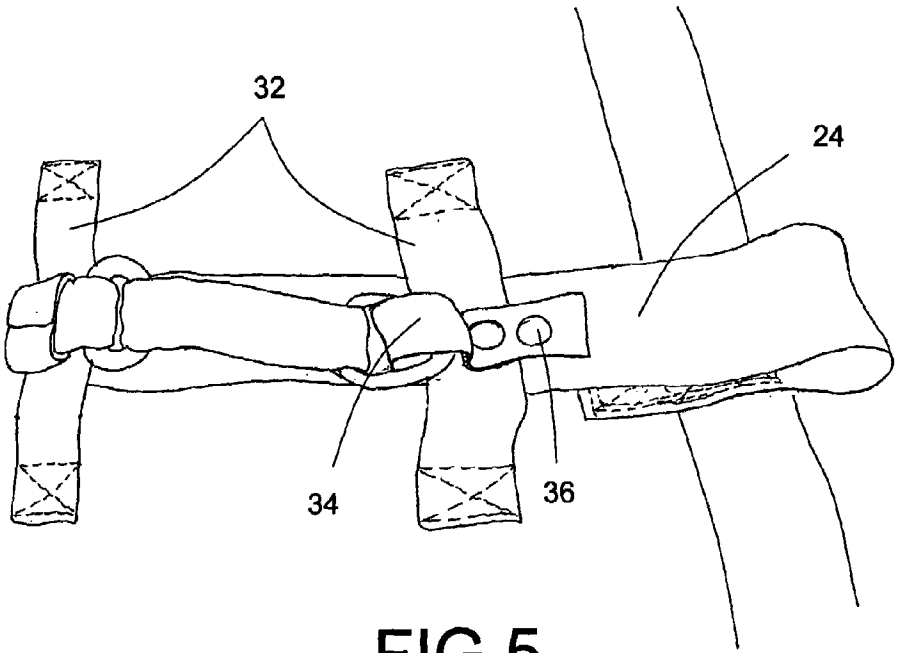
FIG. 5 is a perspective view of a the retaining system used to hold the side belts of the comfort sheet to prevent any body injury when handling the paramedical transfer stretcher designed for a pathologically overweight person according to the preferential purpose of the present invention.
Figure 5A:
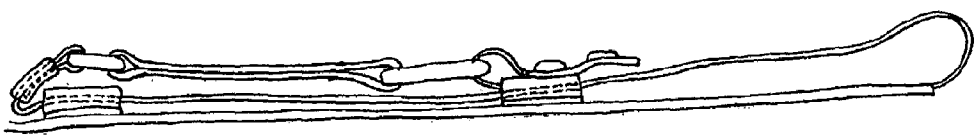
FIG. 5A is a perspective view of a portion of the retaining system shown in FIG. 5.

To prevent any body 12 injury when handling the support canvas 14, the canvas is provided with two retaining systems; a first system for lateral restrain is shown in FIG. 5. This system will hold the belts 24 using two cross bands 32 that can be made of polypropylene and one buckle 34 that can also be made of polypropylene. The buckle is provided with two snap buttons 36.

Figure 6:
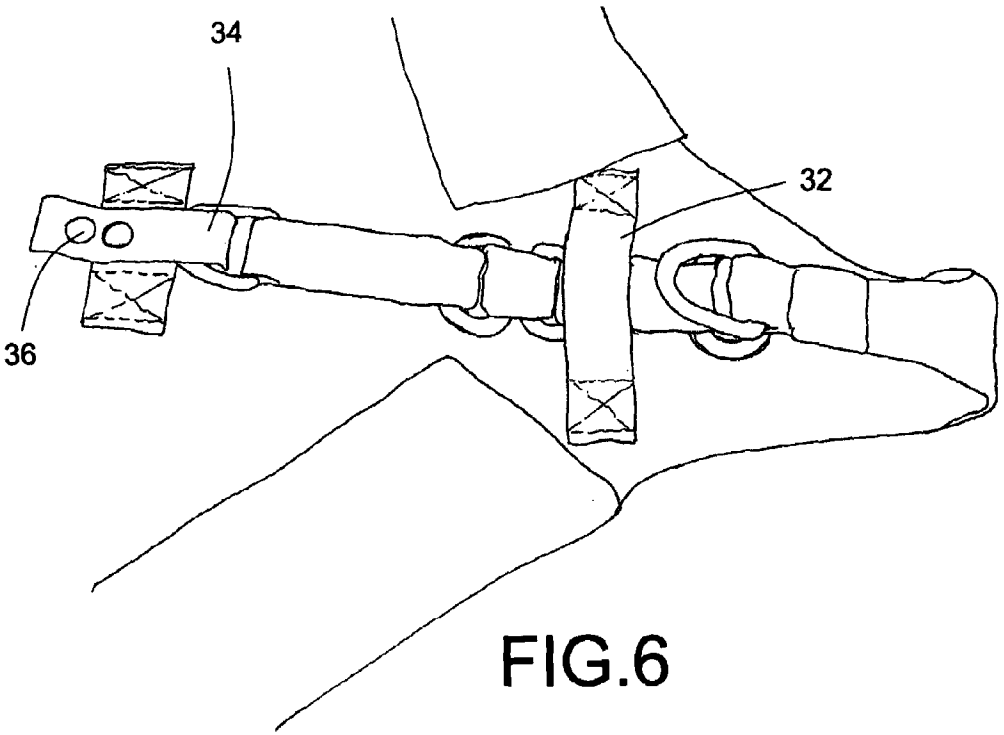
FIG. 6 is a perspective view of the retaining system used to hold the support canvas corner belts to prevent body injuries when handling the paramedical transfer stretcher designed for pathologically overweight person according to the preferential purpose of the present invention.
Figure 6A:
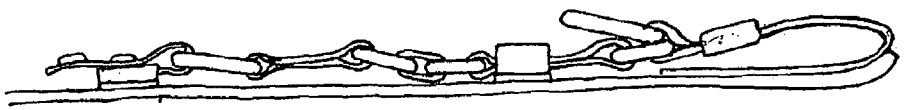
FIG. 6A is a perspective view of a portion of the retaining system shown in FIG. 6.

As shown in FIG. 6, a head retaining system is provided to hold the belts 24 using a buckle 34 equipped with two snap buttons 36.

Other retaining devices such as Velcro® or clips may also work.

Figure 8:
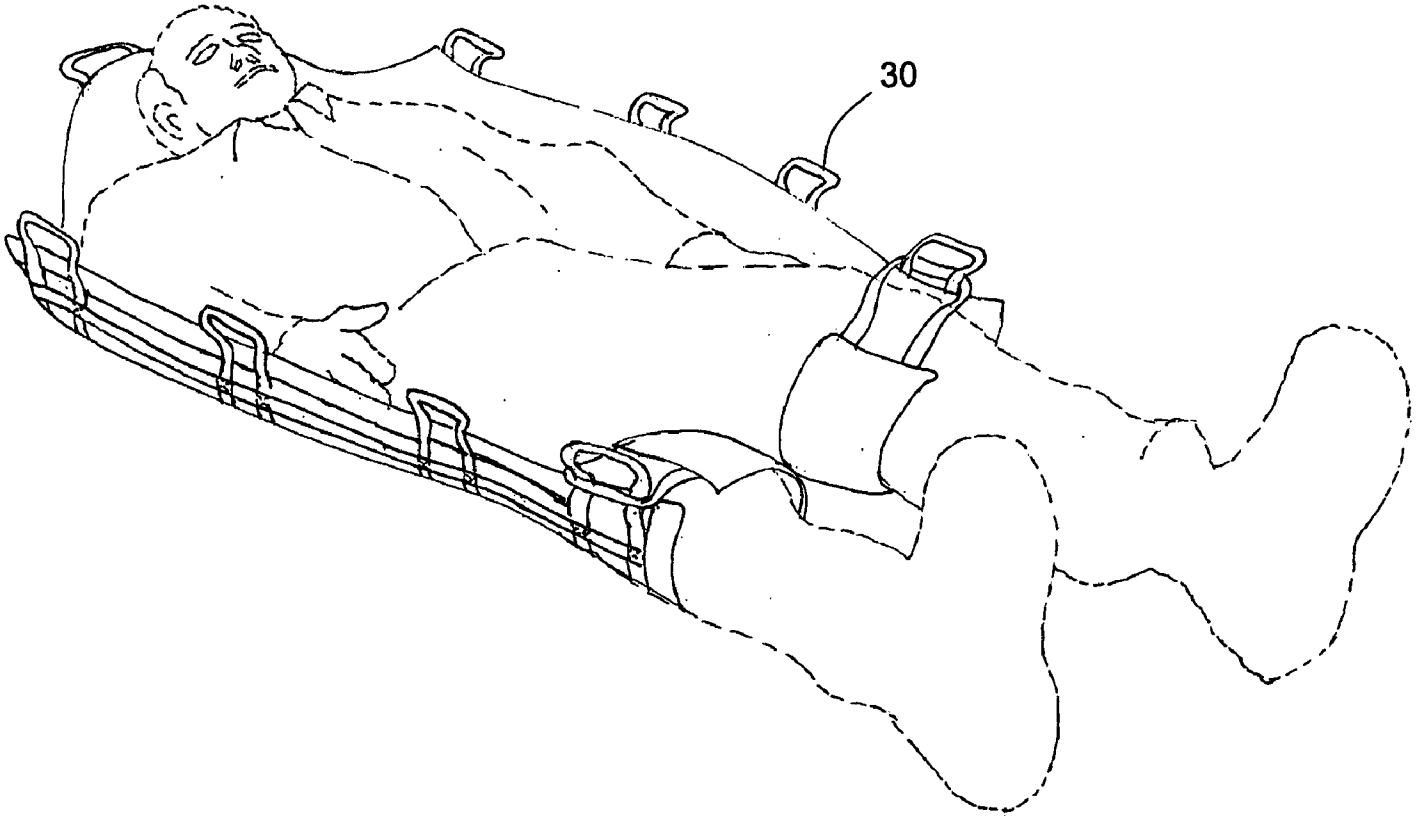
FIG. 8 is a perspective view of a paramedical transfer stretcher for pathologically overweight person, which is designed to allow the manual lifting a person using handles made for this purpose according to the preferential purpose of the present invention.

In the configuration shown in FIG. 8, the support canvas 14 is equipped with handles 30 that are designed to lift the person 12 by hand.

Figures 4, 4A, 4B, 4C:
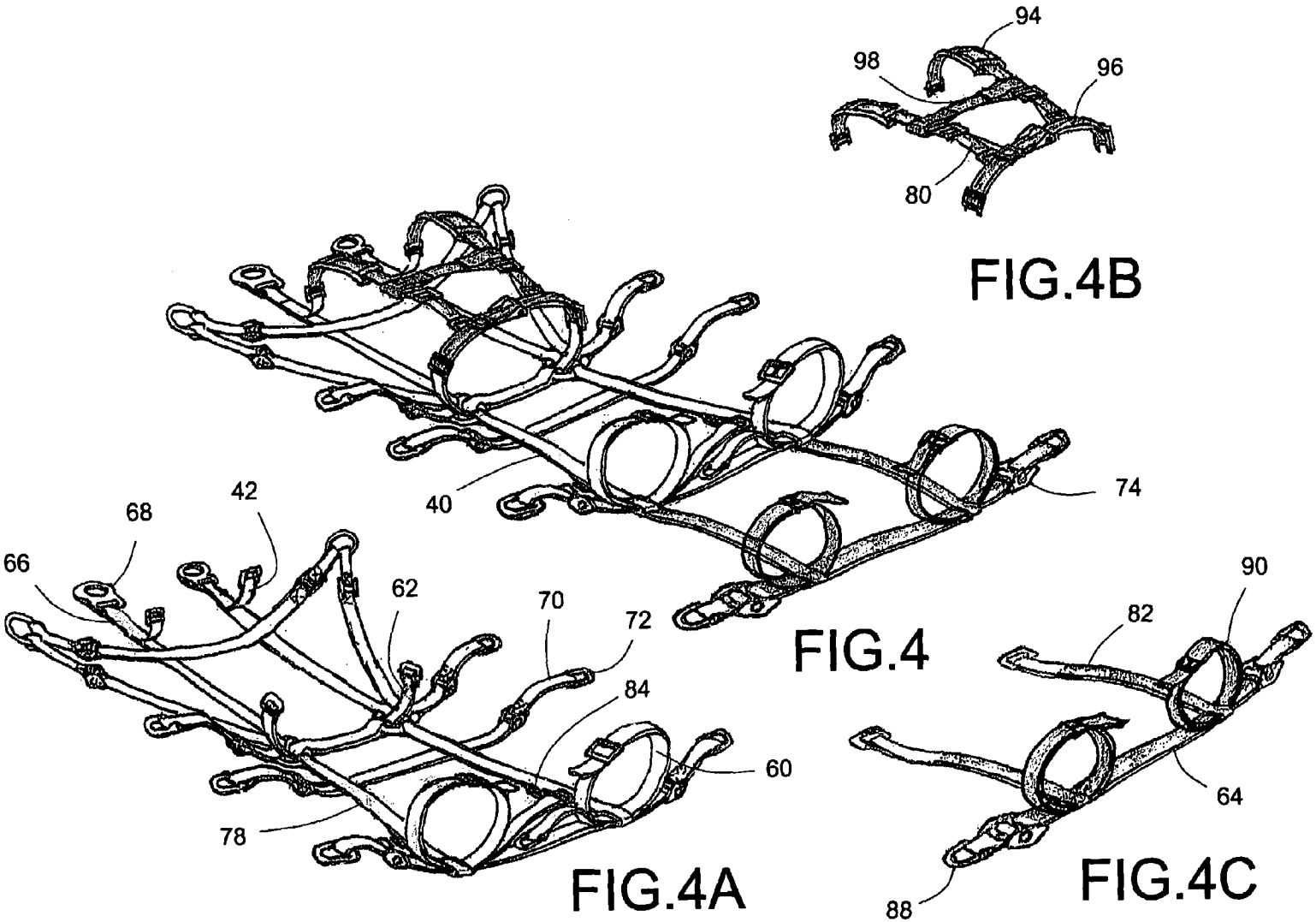
FIG. 4 is a perspective view of a safety harness that can be used with the canvas shown in FIG. 2.
FIG. 4A is a perspective view of a portion of the harness shown in FIG. 4.
FIG. 4B is a perspective view of a portion of the harness shown in FIG. 4.
FIG. 4C is a perspective view of a portion of the harness shown in FIG. 4.

The support canvas 14 may also have openings 38 as shown in FIG. 2 to slide the belts 42, 60, and 62 of harness 40 through the canvas (illustrated in FIGS. 4 and 4A).

Figure 3:
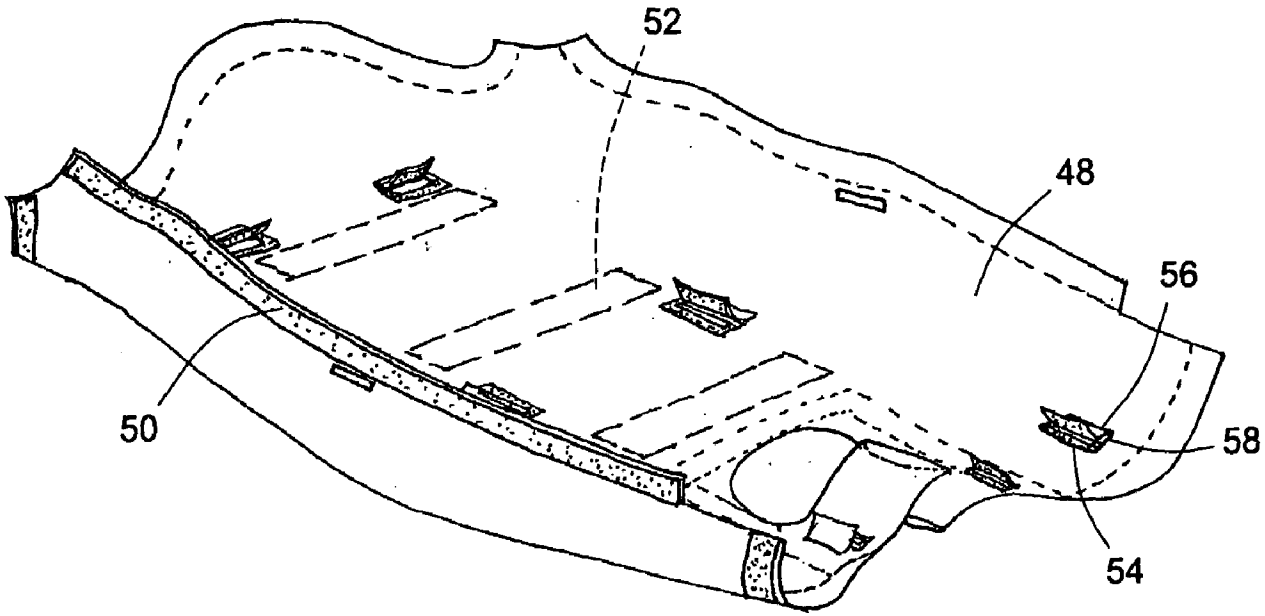
FIG. 3 is a perspective view of a comfort sheet that can be used with the support canvas shown in FIG. 2.

The support canvas will preferably be provided with Velcro® like strips 44 on the edge as well as Velcro® like strips 46 in the centre to retain the comfort sheet 48 in place (see FIG. 3); however, other retaining means can also be used such as zippers, snap buttons, clips, in lieu of Velcro®.

The comfort sheet 48 is preferably made of a medical certified fabric that can catch the body fluids of a person 12. Also, the comfort sheet 48 is washable so as to be hygienically safe.

Furthermore, the comfort sheet is removable, while it is held in place with strips of Velcro® 52 in the centre and with foldable strips of fabrics covered with Velcro®, wrapped around the edge of the sheet, and used to hold it 48 on the support canvas 14. Other retaining means such as zippers, snap buttons, clips can be used. Thus protecting the person 12 from injuries that can be caused by the support canvas 14.

The comfort sheet 48 is also preferably provided with openings 54 to slide the safety harness 40 belts through (illustrated in FIG. 4), along with flaps 56 that are wrapped and around and held in place by a Velcro® 58; however other retaining means such as zippers or snap buttons will work to block the openings if the paramedical transfer stretcher is used without the safety harness 40 as shown in FIG. 7.

A safety harness 40 is also shown in detail in FIGS. 4, 4A, 4B and 4C and can be composed of three pieces.

A first dorsal piece 78 is illustrated in FIG. 4A and is preferably made of two thigh belts or straps 60 that are adjustable between the person 12 crotch and knees.

The dorsal piece 78 has also two belts or straps 42 for the shoulders to receive the front part 80 of the harness 40.

Also, the dorsal piece 78 is provided with two belts or straps 62 at the waist to receive the front part 80 of the harness 40.

The dorsal piece also has two rings 84 to accommodate the optional leg piece 82, as well as two belts 66 with rings 68 to lift the person 12 vertically.

Finally, the dorsal piece is equipped with belts 70 and lifting rings 72, namely to lift the person 12 in a seated position as shown in FIG. 1.

The safety harness 40 can also have a second front piece 80 as shown in FIG. 4B to stabilize the person 12. The front piece 80 can be equipped with two optional padded belts 94 to hold the shoulders and receive the dorsal piece 78 of the harness 40, and a belt 96 to hold the waist and also receive the dorsal pieces 78 of the harness. Moreover, the front piece 80 has a person 12 chest belt 98 to keep a distance between the shoulder belts 94.

As an option, the safety harness 40 can be equipped with a third leg piece 82 as shown in FIG. 4C. The leg piece 82 is preferably provided with a belt 64 to support the legs, along with rings 88 as well as two belts 90 that can be adjustable and are designed to prevent the legs from moving.

Figures 10, 10A:
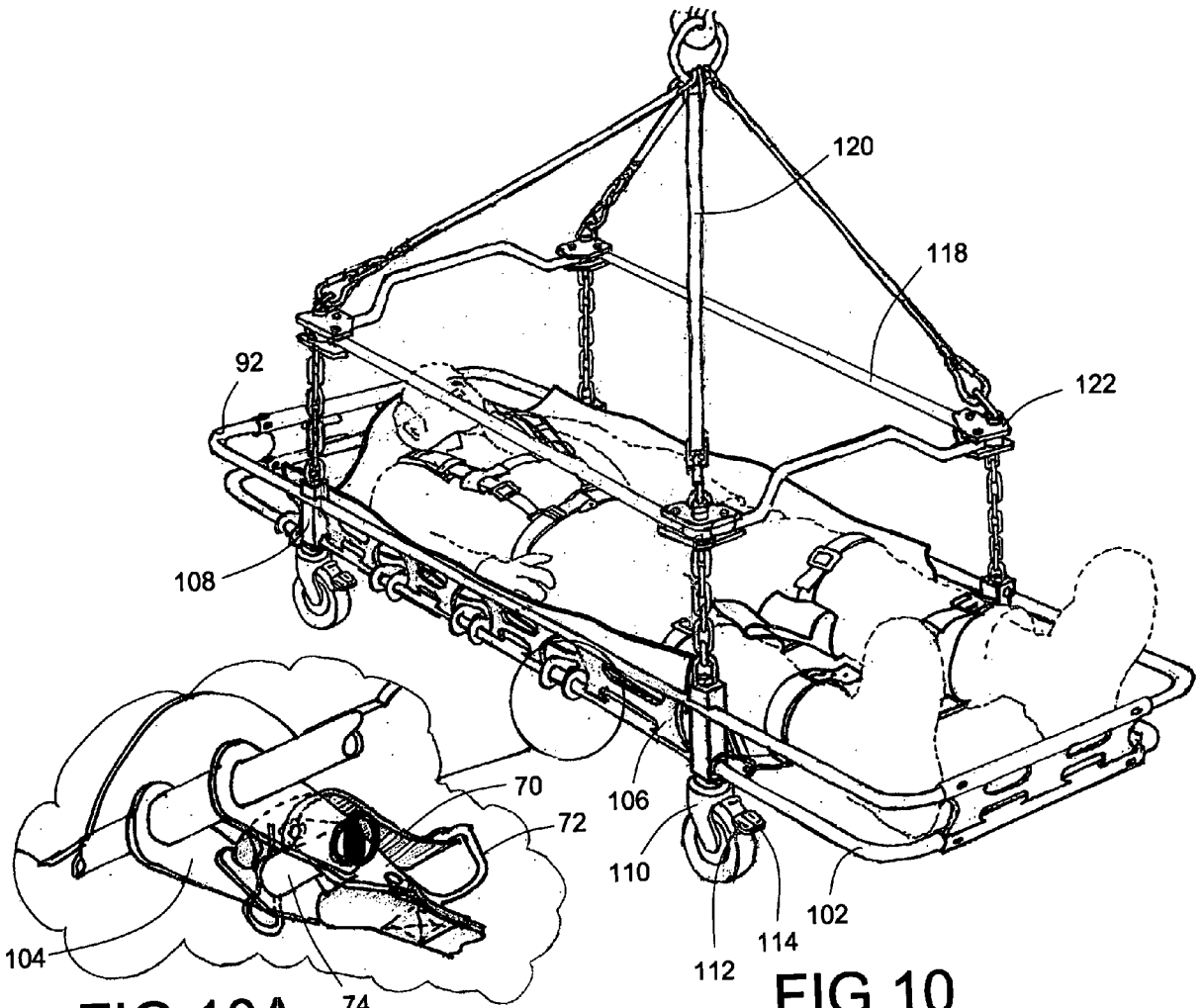
FIG. 10 is a perspective view of a paramedical transfer stretcher for pathologically overweight person, which is designed to lift a person in a horizontal or tilted position with the help of a crane, a basket, a fire truck ladder or any other suitable lifting device, and using a removable bottom stretcher basket, a harness and a sling frame according to the preferential purpose of the present invention.
FIG. 10A is a detail view of the safety harness retaining system to attach the harness to the removable bottom stretcher basket according to the preferential purpose of the present invention.

FIGS. 10 and 10A show the transfer of a pathologically overweight person 12 in a horizontal or slightly tilted position with the help of a stretcher basket 92 that can be used in combination with the paramedical transfer stretcher The transfer stretcher 10 acts as a detachable bottom for the stretcher basket 92 and can include the leg piece 64 of the safety harness 40.

In this configuration, the stretcher basket 92 is provided with a metal frame 102 equipped with fasteners 104 used to secure the paramedical transfer stretcher 10 to the stretcher basket 92, and is equipped of two (preferably removable) side panels 106 allowing to reach the harness retaining rings 74 (FIG. 4) next to the patient 12.

Furthermore, the stretcher basket may be provided with jacks 108 secured to the metal frame 102 to effortlessly lift the person 12. It is preferable to use four jacks so as to obtain a better distribution of the load on each jack, however three jacks will also work. Electrical, hydraulic, air, or mechanical jacks can be used.

Four swivel wheels 110 with breaks 112 and roll locking mechanisms 114 are preferably used on the stretcher basket 92, however three wheels can also work. It is therefore possible to move the person 12 over short distances such as bringing it close to a lifting device 116 (FIG. 1), place/move the person into an ambulance, a health care center or elsewhere.

The stretcher basket 92 can also be provided with a foldable lifting frame 118 with removable slings 120. Preferably three to four slings are required to take up the lateral loads and tilt the stretcher basket when necessary with the help of an adjustment mechanism 122.

Figure 9:
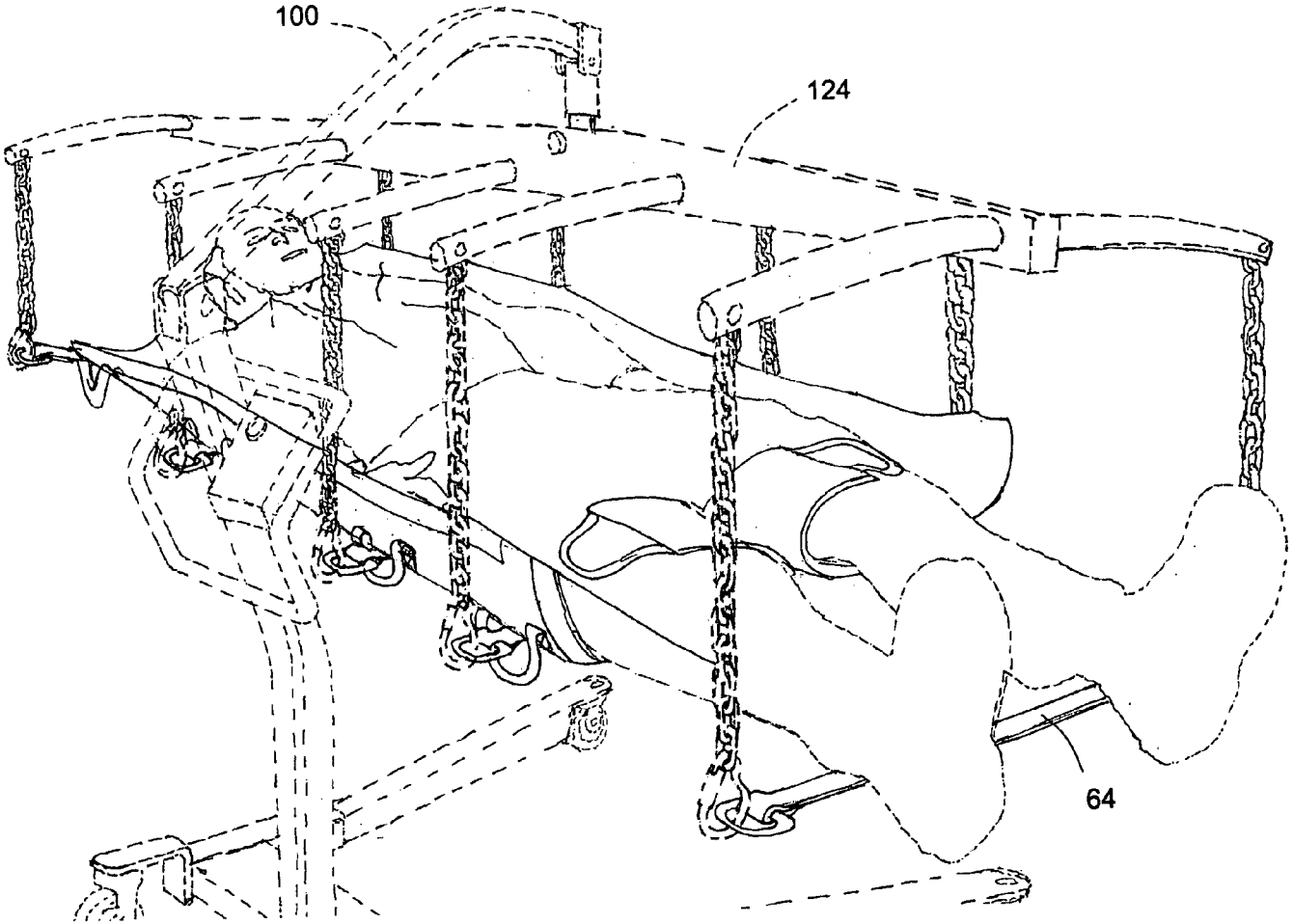
FIG. 9 is a perspective view of a paramedical transfer stretcher for pathologically overweight person, which is designed to lift a person horizontally with the help of body lifting hoist and using the dorsal and leg parts of the harness shown in FIG. 4.

FIG. 9 shows a variation to the horizontal transfer of a person 12 using a body lifting device 100 equipped with a hanger 124 designed for this purpose, and using the paramedical transfer stretcher including in this configuration the leg piece 64 of the safety harness 80 in order to transfer a person 12 from a stretcher to a bed for instance.

The invention claimed is:

1. A stretcher for supporting a person and for transporting said person from a first location to a second location, said stretcher comprising a flexible support canvas for supporting said person, said canvas comprising:

a) a first portion for supporting the torso, the head and the arms of said person;

b) a second portion extending from said first portion, for independently supporting first leg of said person; and c) a third portion, extending from said first portion, for independently supporting second leg of said person;

wherein said canvas further comprises first means for lifting said person with said canvas and wherein said stretcher further comprises a harness mounted to said canvas, said harness being adapted to secure said person to said canvas.

2. A stretcher as claimed in claim 1, wherein said canvas comprises a plurality of layers of materials.

3. A stretcher as claimed in claim 1, wherein said harness comprises:

a) a back portion, mounted to said first portion of said canvas, for supporting the back of said person;

b) a first upper leg portion, mounted to said second portion of said canvas and connected to said back portion of said harness, for supporting and independently securing first upper leg of said person;

c) a second upper leg portion, mounted to said third portion of said canvas and connected to said back portion of said harness, for supporting and independently securing second upper leg of said person.

4. A stretcher as claim in claim 3, wherein said harness further comprises:

a) a first lower leg portion mountable to said first upper leg portion for supporting and independently securing first lower leg of said person;

b) a second lower leg portion mountable to said second upper leg portion for supporting and independently securing second lower leg of said person.

5. A stretcher as claimed in claim 4, wherein said stretcher further comprises a structural frame and wherein amid harness is mountable to said structural frame.

6. A stretcher as claim in claim 3, wherein said harness further comprises a front torso portion mountable to said back portion for securing said torso of said person.

7. A stretcher as claim in claim 3, wherein said harness further comprises:

a) a first lower leg portion mountable to said first upper leg portion for supporting and independently securing first lower leg of said person;

b) a second lower leg portion mountable to said second upper leg portion for supporting and independently securing second lower leg of said person;

c) a front torso portion mountable to said back portion for securing said torso of said person.

8. A stretcher as claim in claim 3, wherein said harness further comprises second means for lifting said canvas and said person with said harness.

9. A stretcher as claimed in claim 3, wherein said stretcher further comprises a structural frame and wherein said harness is mountable to said structural frame.

10. A stretcher as claimed in claim 1, wherein said harness is removably mounted to said canvas.

11. A stretcher as claimed in claim 1, wherein said harness is fixedly mounted to said canvas.

12. A stretcher for transporting a person from a first location to a second location, said stretcher comprising:

a) a flexible support canvas for supporting said person, b) a harness, mounted to said support canvas, said harness comprising:

i) a back portion for supporting the back of said person;

ii) a first upper leg portion, connected to said back portion, for supporting and independently securing first upper leg of said person;

iii) a second upper leg portion, connected to said back portion for supporting and independently securing second upper leg of said person;

wherein said harness further comprises first means for lifting said person and said canvas with said harness.

13. A stretcher as claim in claim 12, wherein said harness further comprises:

a) a first lower leg portion mountable to said first upper leg portion for supporting and independently securing first lower leg of said person;

b) a second lower leg portion mountable to said second upper leg portion for supporting and independently securing second lower leg of said person.

14. A stretcher as claimed in claim 13, wherein said stretcher further comprises a structural frame and wherein said harness is mountable to said structural frame.

15. A stretcher as claim in claim 12, wherein said harness further comprises a front torso portion mountable to said back portion for securing said torso of said person.

16. A stretcher as claim in claim 12, wherein said harness further comprises:

a) a first lower leg portion mountable to said first upper leg portion for supporting and independently securing first lower leg of said person;

b) a second lower leg portion mountable to said second upper leg portion for supporting and independently securing second lower leg of said person;

c) a front torso portion mountable to said back portion for securing said torso of said person.

17. A stretcher as claim in claim 12, wherein said canvas comprises:

a) a first portion for supporting the torso, the head and the arms of said person;

b) a second portion, extending from said first portion, for independently supporting first leg of said person; and c) a third portion, extending from said first portion, for independently supporting second leg of said person.

18. A stretcher as claimed in 17, wherein said first portion of said canvas is mountable to said back portion of said harness, said second portion of said canvas is mountable to said first upper leg portion of said harness and said third portion of said canvas is mountable to said second upper leg portion of said harness.

19. A stretcher as claimed in claim 17, wherein said canvas further comprises second means for lifting said person with said canvas.

20. A stretcher as claimed in claim 17, wherein said canvas comprises a plurality of layers of materials.

21. A stretcher as claimed in claim 12, wherein said stretcher further comprises a structural frame and wherein said harness is mountable to said structural frame.

22. A stretcher as claimed in claim 12, wherein said harness is removably mounted to said canvas.

23. A stretcher as claimed in claim 12, wherein said harness is fixedly mounted to said canvas.

24. A stretcher for transporting a person from a first location to a second location, said stretcher comprising:

a) a structural frame;

b) a flexible support canvas for supporting said person;

c) a harness, mounted to said support canvas, said harness comprising;

i) a back portion for supporting the back of said person;

ii) a first upper leg portion, connected to said back portion, for supporting and independently securing first upper leg of said person;

iii) a second upper leg portion, connected to said back portion, for supporting and independently securing second upper leg of said person;

wherein said harness is mountable to said support frame whereby said harness and said support canvas define said bottom of said stretcher.

25. A stretcher as claimed in claim 24, wherein said harness further comprises:

a) a first lower leg portion mountable to said first upper leg portion for supporting and independently securing first lower leg of said person;

b) a second lower leg portion mountable to said second upper leg portion for supporting and independently securing second lower leg of said person.

26. A stretcher as claimed in claim 24, wherein said harness is removably mounted to said canvas.

27. A stretcher as claimed in claim 24, wherein said harness is fixedly mounted to said canvas.

* * * * *